US005127836A

United States Patent [19]

Reuter

[11] Patent Number: 5,127,836

[45] Date of Patent: Jul. 7, 1992

[54] ROTATABLE HIGH CURRENT CONNECTOR

[75] Inventor: Wolfgang Reuter, Niddatal, Fed. Rep. of Germany

[73] Assignee: Leybold Aktiengesellschaft, Hanau I, Fed. Rep. of Germany

[21] Appl. No.: 748,248

[22] Filed: Aug. 21, 1991

[30] Foreign Application Priority Data

Jul. 8, 1991 [DE] Fed. Rep. of Germany ..... 4122574

[51] Int. Cl.[5] ..... H01R 39/00

[52] U.S. Cl. ..... 439/3; 439/164

[58] Field of Search ..... 439/3, 164, 13, 161, 439/162

[56] References Cited

U.S. PATENT DOCUMENTS 2,575,409 11/1951 Cooper et al. ..... 439/3
2,885,647 5/1959 Winkler ..... 439/164
2,899,667 8/1959 Bredtschneider et al. ..... 439/3

FOREIGN PATENT DOCUMENTS 403836 1/1946 Italy ..... 439/164

*Primary Examiner*—Eugene F. Desmond
*Attorney, Agent, or Firm*—Felfe & Lynch

[57] ABSTRACT

Rotatable high-current connector consisting of a coaxial arrangement of an electrically conductive inner tube (2) and of an outer tube (3), whose hollow interiors (4, 5) serve for carrying a coolant, and which are joined, at their extremities connected to a stationary power line, each with a metal flange (8, 9) from which flexible current bridges, such as stranded wires example (12, 12', . . . ; 13, 13'. . . ,), lead each to a corresponding metal counter-flange (14, 15) on the stationary power line, the counter-flanges (14, 15) being equipped with a coaxial current carrying device, preferably with current carrying tubes (19, 20, 22, 23) of different diameters disposed coaxially with one another, and these tubes (19, 20, 22, 23) are of not less than a minimum length.

3 Claims, 1 Drawing Sheet

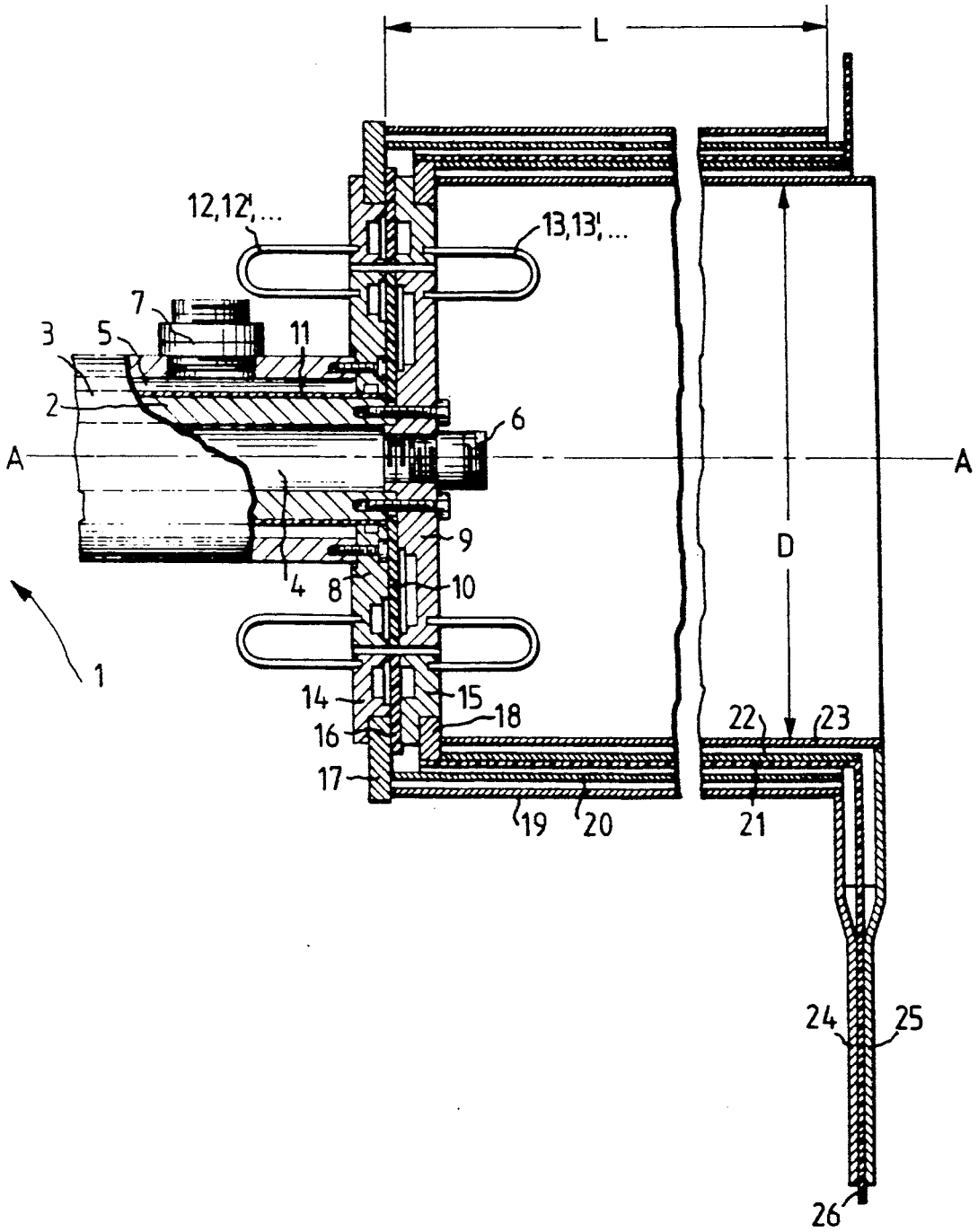
L
12,12',...
13,13',...
7
3
5
11
2
6
A
A
9
D
4
8
10
1
14
15
18
16
17
22
23
19
20
21
24
25
26

ROTATABLE HIGH CURRENT CONNECTOR

BACKGROUND OF THE INVENTION

The invention relates to a rotatable high-current connector for feeding electrical lines through to movable elements in closed spaces such as a vacuum chamber includes a coaxial arrangement of an inner current carrying tube and an outer current carrying tube insulated from each other. Each tube has a metal flange connected to a corresponding concentrically situated counter flange by flexible current bridges to permit rotation between the flanges and the counter flanges.

High-current connectors of the above-described kind are needed, for example, of the input of heavy working currents into closed spaces whenever limited rotating and turning movements have to be performed between components inside and outside of the walls of these spaces. This need consists, for example, in the case of electrically powered apparatus, especially those supplied at medium frequency, such as melting and casting apparatus in which the molten material is cast by the tipping of a crucible, wherein the heating means forms one unit with the crucible.

It is especially important in this case that the high-current connector serve simultaneously also for the entry and exit of a coolant by which furnace parts, such as an induction coil, are protected against overheating.

In apparatus where there are pressure differences on both sides of the walls of the closed chambers, as for example in vacuum furnaces, the sealing of the high-current connectors has to satisfy special requirements. High-current connectors of the kind described above, however, are not limited to use in melting and casting furnaces.

A high-current connector of the kind described above has been the prior art for many years due to public usage. It consists of four metal annular flanges which are arranged concentrically one inside the other in paris and joined together by loops of stranded wire so that one inner and one outer flange are at the same potential. The annular flanges of different polarity arranged back-to-back are insulated electrically from one another by spacer rings, but mechanically they form one unit, the inner annular flanges being able to perform a limited turing movement against the outer annular flanges. The stranded wires are in this case fastened at their ends in the flanges by means of set screws, for example. The strands of wire of the one potential are approximately in mirror-image symmetry with those of the other potential, the plane of symmetry being approximately inside of the insulating spacer rings between the flanges. The angle of movement is provided for by making the looped length of the stranded wires sufficiently great. The inner, rotatable annular flanges have different diameters and are situated on the outer surfaces of the coaxial tubes which carry the current and the coolant through the wall of the closed chamber to the movable components therein.

The supply of electric current to the outer, stationary counter-flange is accomplished in accordance with German Patent 32 19 721 (U.S. Pat. No. 4,492,423) by means of two tangentially disposed tubular conductors which are configured simultaneously as coolant lines.

In a configuration of the above-described kind, however, the disadvantage has been encountered that the transfer of high electric currents is problematical. The introduction of the electric current into the counter-flange takes place at only one radially external point. Since the electric current tends to flow along the shortest possible path, no distribution to the annular counter-flange takes place. Instead, the current flows through the stranded wires situated close to the conductor into the counter-flange. This in turn causes different thermal loading of the stranded wires, and for this reason they are made with different diameters.

SUMMARY OF THE INVENTION

The invention is addressed to the problem of creating a design for the high-current connector which will permit a uniform distribution of the electric current over the circumference of the counter-flange and thus prevent unequal heating of the stranded wires, as well as the transfer of higher currents than has been possible heretofore.

This problem is solved by providing the counter-flanges with a coaxial current feeding system, preferably having current carrying tubes of different diameters disposed coaxially with one another, and these tubes have no less than a minimum length (L), the length (L) being preferably greater than twice the diameter (D) of the current carrying tube with the smallest diameter.

The coaxial current feeding system advantageously satisfies the requirement of a uniform current density distributed over the circumference, which now also permits its use at high currents.

BRIEF DESCRIPTION OF THE DRAWING

The sole figure shows an axial section through the one end of a rotatable high-current connector having the coaxial condition of current in accordance with the invention.

DETAILED DESCRIPTION OF THE PREFERRED EMBODIMENT

The high-current connector contains an electrically conducting cylindrical inner tube 2 as will as an outer tube 3 which has a shorter length and is concentric with the inner tube 2. The outer tube is held in a wall of a vacuum chamber 1 by means of a rotary lead-through which is state of the art and therefore not shown. In the inner tube 2 is a cavity 4 for carrying a coolant; between the inner tube 2 and outer tube 3 an annular space 5 is formed which likewise serves to carry the coolant. The inner cavity 4 is connected by a threaded nipple 6 to a flexible coolant tube not shown. The outer chamber 5 is likewise connected by a lateral threaded nipple 7 to a flexible coolant water line.

The end of the outer tube 3 is fixedly joined to a metal flange 8 which has an inside rim reaching into the hollow chamber 5 and thus is in direct contact during operation with the coolant in chamber 5. The flange 8 is provided with a radial groove not further indexed, in which a gasket, not shown, is disposed for sealing against the inner tube 2. No rotary movement takes place between the inner tube and outer tube, since the two tubes form a fixed system in which they move together.

A flange 9 is likewise affixed to the end face of the inner tube 2. The nipple 6 is screwed into the center of the flange 9.

Between the two flanges 8 and 9 is a spacer ring 10 consisting of insulating material. The inner tube has on a portion of its length an insulating covering 11 which reaches as far as the spacer ring 10, so that the given potential difference between the flange 8 and the inner tube 2 can be maintained. Also, the flanges 8 and 9 as well as the spacer ring 10 are nonrotatable relative to one another and form a rigid assembly.

In the radially outer portions of flanges 8 and 9 there are a number of axially aligned bores at equal distances apart, into which looped stranded wires, 12', . . . , 13,13', . . . are soldered each at its one end.

The other ends of the stranded wires 12', . . . , 13,13', . . . are soldered in counter-flanges 14 and 15, respectively, which are provided for this purpose with the same number of axially aligned bores as flanges 8 and 9. These counter-flanges 14 and 15 are disposed in a position radially outside of (concentric to) respective flanges 8 and 9, but without touching them. Between the counter-flanges 14 and 15 is a spacer ring 16 consisting of insulating material with which the counter-flanges 14 and 15 are screwed together to form a rigid assembly.

The counter-flanges 14 and 15 are joined at the radially outer ends each with a flat circular ring 17 and 18; ring 7 radially overlaps ring 18.

The two rings 17 and 18 are joined each to two thin-walled cylindrical tubes 19,20,22 and 23, which are disposed concentrically with one another without contact between them, with a separating space. Ring 22 is provided with a likewise cylindrical, electrical insulator 21, so that the different pluralities of the outer pair of tubes 19 and 21 and of the inner pair of tubes 22 and 23 are separated from one another.

The entire system thus far described is largely rotationally symmetrical with respect to the axis A—A.

The two tube pairs 19,20, and 22,23, are in contact at their free ends each with a radially disposed bus 24,25, an insulator 26 being disposed between the two buses 24 and 25, whose radially inner end is joined to the insulator 21. Through thee two buses 24 and 25 an electrical power is delivered which distributes itself on the circumference of the current carrying tubes 19,20,22 and 23, and thus permits a coaxial transfer of the electric power through the counter-flanges 14 and 15 and the flexible current bridges 12, 12', . . . , 13,13', . . . to the current-carrying tubes 2 and 3.

A relative rotary movement of the above-described high-current connector takes place between the two flange pairs 8, 9 and 14, 15; the possible rotational angle (of rotatable parts 2,3,8 and 9 with respect to the fixedly mounted power conducting tubes 19,20,22,23) is limited by the stretching length of the flexible current bridges 12, 12', . . . ; 13, 13', . . . .

I claim:

1. Rotatable electrical connector for bringing electrical power lines through to movable components in enclosed spaces, comprising an electrically conductive inner tube having a coolant cavity therein and an end with a metal flange extending radially outward therefrom, an electrically conductive outer tube concentric to and electrically insulated from said inner tube, said outer tube having a metal flange extending radially outward therefrom, a space between said inner tube and said outer tube for carrying coolant, a first current carrying tube having a metal counter flange electrically connected to said flange of said inner tube by flexible current bridge means, said first tube having an inner diameter, and a second current carrying the concentric to said first current carrying tube and having a metal counter flange electrically connected to said flange of said outer tube by flexible current bridge means, said second tube having a length greater than twice said diameter.

2. Rotatable connector as in claim 1 wherein said counter flange of said first current carrying tube is concentric to and coplanar with said flange of said inner tube, and said counter flange of said second current carrying tube is concentric to and coplanar with said flange of said outer tube.

3. Rotatable connector as in claim 1 wherein said flexible current bridge means each comprise a plurality of bridges uniformly distributed about the circumference of the flanges which the bridges connect.

* * * * *

UNITED STATES PATENT AND TRADEMARK OFFICE

CERTIFICATE OF CORRECTION

PATENT NO. : 5,127,836

DATED : July 7, 1992

INVENTOR(S) : Wolfgang Reuter

It is certified that error appears in the above-identified patent and that said Letters Patent is hereby corrected as shown below:

Column 1, line 40, delete "paris" and insert --pairs--

Column 3, lines 7 and 9, after "wires" insert --12--

Column 3, line 22, delete "ring 7" and insert --ring 17--.

Signed and Sealed this

Eighth Day of February, 1994

Bruce Lehman

*Attest:*

BRUCE LEHMAN

*Attesting Officer*

*Commissioner of Patents and Trademarks*